US006935712B2

(12) United States Patent
Reed et al.

(10) Patent No.: US 6,935,712 B2
(45) Date of Patent: Aug. 30, 2005

(54) REFRIGERATION UNIT

(75) Inventors: William A. Reed, Cedarburg, WI (US); Thomas W. Rand, Cedarburg, WI (US); Dean G. Byczynski, Hartland, WI (US); Joseph E. Braun, Milwaukee, WI (US); Andrew J. Doberstein, West Bend, WI (US); Lawrence D. Moye, Kewaskum, WI (US); Jack L. Vaughn, Hartford, WI (US); Jeffrey A. Ziminski, Milwaukee, WI (US)

(73) Assignee: U-Line Corporation, Milwaukee, WI (US)

( * ) Notice: Subject to any disclaimer, the term of this patent is extended or adjusted under 35 U.S.C. 154(b) by 183 days.

(21) Appl. No.: 10/076,746

(22) Filed: Feb. 14, 2002

(65) Prior Publication Data

US 2003/0151339 A1 Aug. 14, 2003

(51) Int. Cl.[7] ..... A47B 96/00

(52) U.S. Cl. ..... 312/405; 312/401; 312/405.1; 312/408; 312/204

(58) Field of Search ..... 312/401, 404, 312/405, 405.1, 406, 408, 410, 116, 350, 351, 204; 40/606.07, 606.04, 606.08, 611.05

(56) References Cited

U.S. PATENT DOCUMENTS

| | | | | | |
|---|---|---|---|---|---|
| 2,251,799 | A | * | 8/1941 | Nave | 312/408 |
| 2,576,691 | A | * | 11/1951 | Money | 312/405.1 |
| 3,220,558 | A | * | 11/1965 | Olsson | 211/74 |
| 3,628,845 | A | | 12/1971 | Grimm | |
| 3,690,744 | A | * | 9/1972 | Squire | 312/351 |
| 3,797,903 | A | * | 3/1974 | Traulsen | 312/116 |
| 4,090,274 | A | | 5/1978 | Bourgeois | |
| 4,774,740 | A | | 10/1988 | Gidseg et al. | |
| 4,864,691 | A | | 9/1989 | Gidseg et al. | |
| D337,932 | S | | 8/1993 | Reed et al. | |
| 5,346,299 | A | * | 9/1994 | Werkmeister et al. | 312/405.1 |
| 5,369,842 | A | * | 12/1994 | Beatty | 16/317 |
| 5,370,455 | A | * | 12/1994 | Sedovic et al. | 312/405.1 |
| 5,496,104 | A | * | 3/1996 | Arnold et al. | 312/204 |
| 5,500,984 | A | | 3/1996 | Lee | |
| 5,893,620 | A | * | 4/1999 | Birgelis | 312/408 |
| 6,053,585 | A | * | 4/2000 | Osen | 312/204 |
| 6,105,233 | A | * | 8/2000 | Neal | 29/451 |
| 6,220,437 | B1 | * | 4/2001 | Knoy et al. | 206/454 |
| 6,231,146 | B1 | * | 5/2001 | Dang | 312/405.1 |
| 6,238,032 | B1 | * | 5/2001 | Cooper et al. | 312/401 |

FOREIGN PATENT DOCUMENTS

| | | | | |
|---|---|---|---|---|
| DE | 222147 | * | 7/1962 | 312/321.5 |

OTHER PUBLICATIONS

"Kitchen Trim and Panel Kits" by Frigo Designs, kitchen accessories unlimited, 4 pages, 12–1996.*

U–Line Corporation, Ice Makers product brochure, Aug. 1998, Milwaukee, Wisconsin, USA, 2 pages.

U–Line Corporation, Product Brochure, Jun. 2000, Milwaukee, Wisconsin, USA, 16–pages.

* cited by examiner

*Primary Examiner*—James O. Hansen
(74) *Attorney, Agent, or Firm*—Quarles & Brady LLP

(57) ABSTRACT

A refrigeration unit with improved storage and accessibility features has a thermally insulated cabinet and door defining a storage space with a plurality of support elements. The support elements include easily removable door shelves and horizontal cabinet shelves that can be removed or repositioned without the door being fully opened due to dished regions adjacent the shelf supports that allow the shelves to be pivoted and removed rather than slid straight out of the cabinet. Indicia on one of the shelves follows the contour of one of the door shelves to indicate approximately the shelf space occupied by an adjacent door shelf and thus where items can be set without interfering with the closure of the door. The refrigeration unit also includes a cam assembly at the lower door hinge which biases the door closed when open approximately 35 degrees or less. The refrigeration unit also includes features for attaching an overlay panel to the door easily.

22 Claims, 17 Drawing Sheets

10
12
12
12
94
22
28
24
38
24
14
40
28
24
24
26
24
20

FIG. 22
FIG. 20
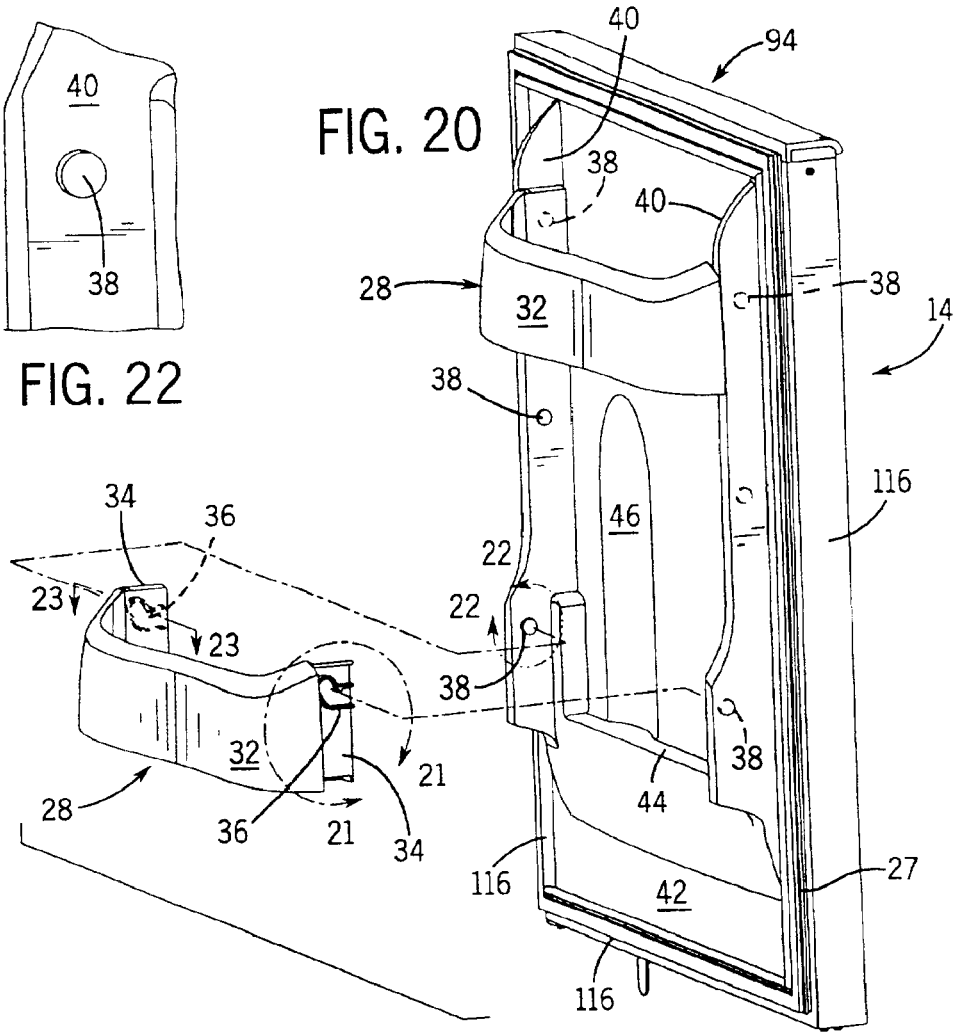
FIG. 23
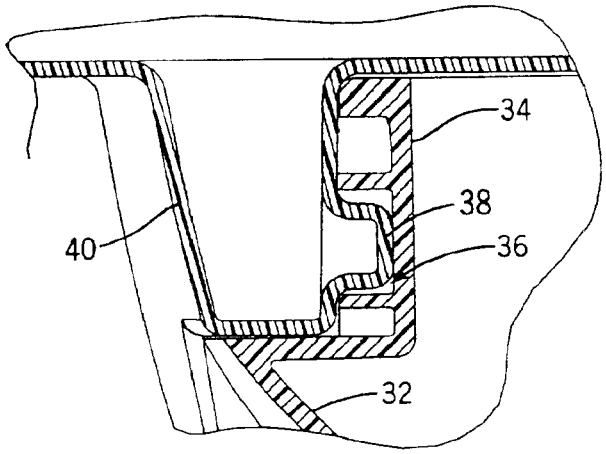
FIG. 21
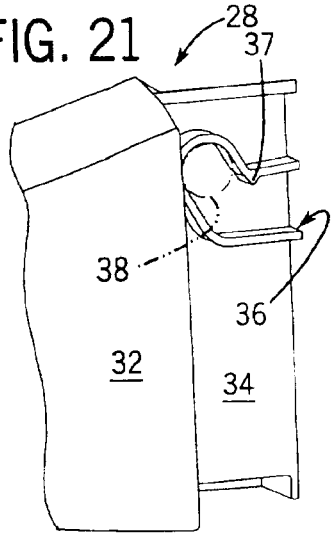

FIG. 25
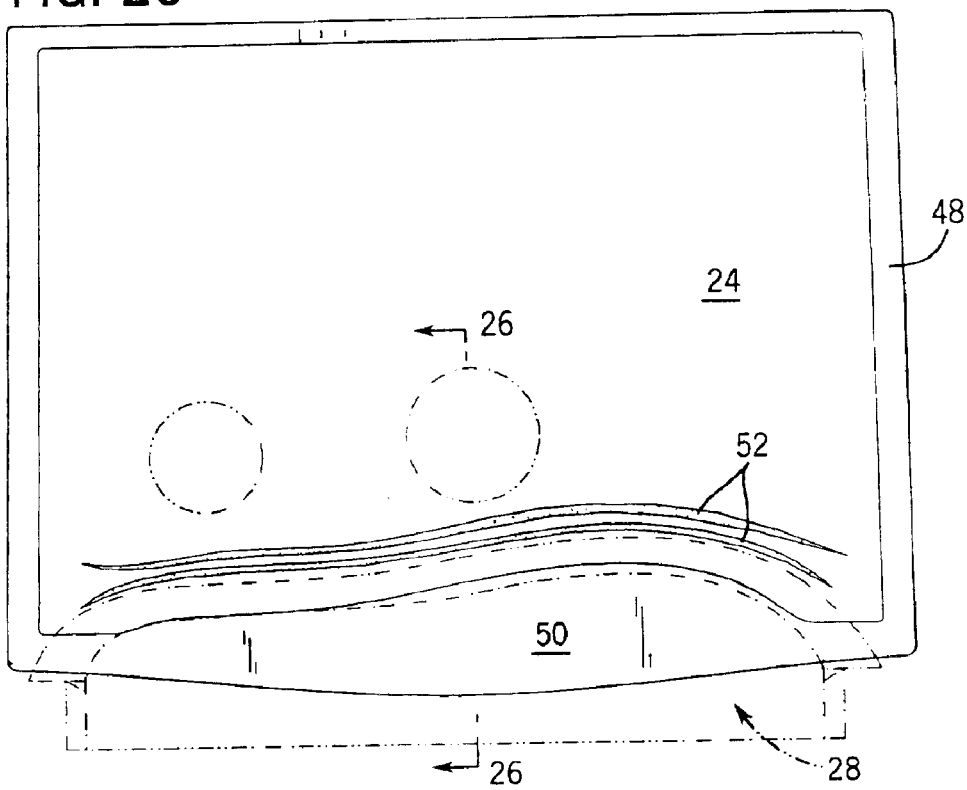
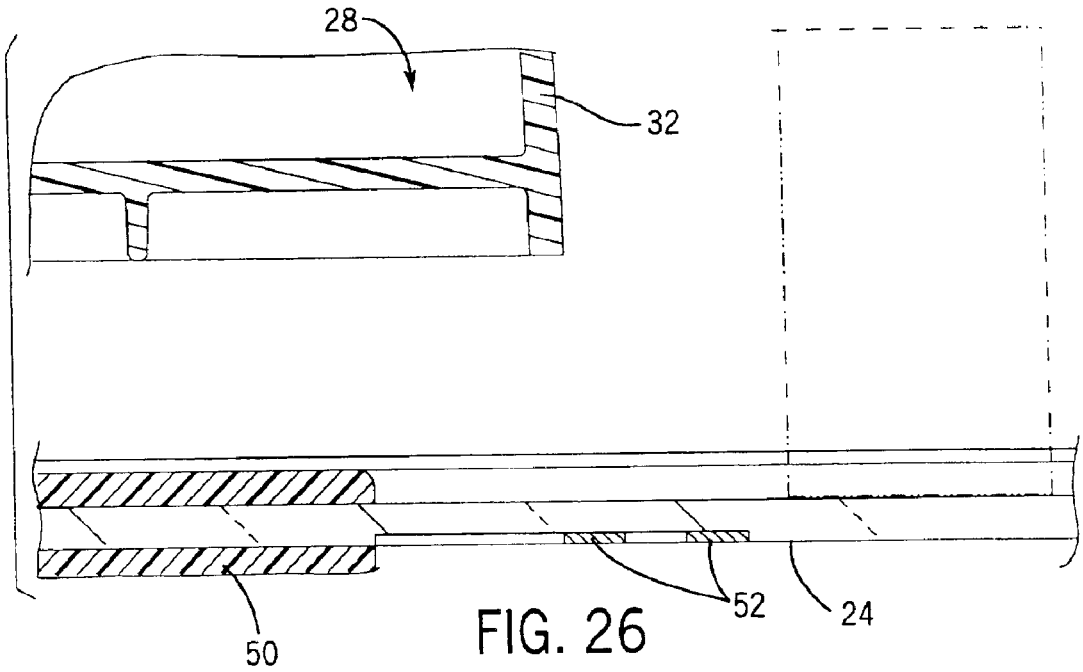
FIG. 26

REFRIGERATION UNIT

BACKGROUND OF THE INVENTION

CROSS-REFERENCE TO RELATED APPLICATIONS

Not applicable.

STATEMENT OF FEDERALLY SPONSORED RESEARCH OR DEVELOPMENT

Not applicable.

This invention relates to storage units, such as coolers and refrigerators, and in particular, the invention relates to refrigeration units with improved storage and accessibility features.

Cold storage units, such as refrigerators, freezers and beverage coolers, are well known, virtually indispensable appliances. There has thus been numerous refinements and improvements made to these devices to address and correct deficiencies in the prior art. One problem that has been addressed concerns the operation of the door. Industrial and in-home refrigeration units, for example, have large hinged doors. It is common for these doors to include shelving for holding, for example, condiments, beverages and other bottled goods, which can substantially increase the weight of the door. As a result, the door can become cumbersome to close and keep open. Moreover, if the door does not close and seal properly cool air will escape and raise the temperature in the cabinet, thus causing the compressor to run continuously and waste energy.

Various hinge assemblies have been developed to address these problems. For example, U.S. Pat. Nos. 3,628,845; 4,090,274 and 5,500,984 disclose refrigerators with opposing cam members at one or more hinges that have ramped surfaces operating to bias the door closed when it is open at some acute angles. U.S. Pat. Nos. 4,774,740 and 4,864,691 provide hinge assemblies that include opposing cams that provide staged rotation of the door to hold it at predetermined open positions. While these systems provide the intended benefit, they require rather complex assemblies.

Another problem with conventional refrigeration units is that the shelves are sometimes immovable or are difficult to remove or reposition. Also, the door shelves are often too small to hold common items, such as beverages in liter and gallon containers, and if they are deep enough to accommodate such sized items, they often interfere with items on the cabinet shelving. This can cause items to be spilt or damaged by the door shelving and more importantly, it can interfere with the door closing and sealing properly.

Another issue primarily of concern to home owners, is that because refrigeration units are not made of wood, they do not match adjacent cabinetry, thus creating an unpleasant appearance by some standards. One known solution is to conceal the appliance with one or more panels of the same wood and stain of neighboring cabinets. Usually, such panels are mounted directly to the door, however, this can require considerable retrofitting.

SUMMARY OF THE INVENTION

The present invention provides a solution to the above problems of the prior art. In one aspect, the invention provides a refrigeration unit having a cabinet defining a storage cavity open at a front side that is covered by a door mounted to the front of the cabinet by two hinge assemblies.

At least one of the hinge assemblies includes a pair of mounting brackets spaced apart along a pivot axis on each side of a cam assembly. The cam assembly includes two cams with mating undulating face surfaces, each with at least one oblique ramp surface. Each cam has a back surface opposite the face surface that defines a key member. Each key member engages a corresponding key member in each of the mounting brackets to prevent relative rotation of the cams with respect to the brackets to which they are mounted. The cams rotate with respect to each other when the door is opened and closed such that engagement of the opposing ramp surfaces biases the door toward the cabinet.

In preferred embodiments, the cam assembly is part of a lower hinge assembly. Each cam is made of a low friction, lubricious material and has two radially spaced ramp surfaces aligned for engagement with the ramp surfaces of the opposing cam. Each cam also has two key members in the form of axially extending pins which fit into openings through the mounting brackets. The back side of one cam defines a sleeve extending through an opening in the corresponding mounting bracket, which preferably is a flat plate mounted to the door. A hinge pin disposed along the pivot axis fits through axial openings (and the sleeve) in the cams to unite the cams.

Another aspect of the invention provides a refrigeration unit in which the door has an inner surface with at least one pair of vertically aligned shelf support mounts. The shelf support mounts support at least one door shelf having a bottom and a side rail with opposite ends extending generally perpendicular to the door. The ends of the side rail define a pair of shelf mounts for engaging the shelf support mounts such that the door shelf can be detached from the shelf support by tilting the door shelf with respect to the shelf support and moving the door shelf away from the door.

In preferred embodiments, a thermoformed plastic insert liner defines the inner surface of the door. The liner is formed with a pair of laterally spaced uprights that include the shelf support mounts, which preferably are laterally inwardly extending bosses. The shelf mounts are tracks sized to receive the bosses. The tracks have an open end toward the terminal side of the side rail ends and define a straight portion adjacent the open end and an angled portion extending at an oblique angle from the straight portion to a closed end.

Another aspect of the invention provides a refrigeration unit in which the cabinet has opposite inner walls defining a pair of vertically aligned rests for a planar shelf. One of the inner walls defines a concave recess adjacent an upper side of the rest such that the shelf can be pivoted upward about the opposite rest so that the shelf can be dislocated from both rests and removed from the cabinet without the door being swung totally clear of the opening. Preferably, a thermoformed plastic insert liner forms the inner wall of the cabinet and has a plurality of vertically aligned rests spaced apart at different heights within the storage cavity so as to support a plurality of shelves.

Yet another aspect of the invention provides a refrigeration unit with a door shelf extending into the storage cavity and a planar shelf supported by the cabinet in a horizontal orientation within the storage cavity such that a front portion of the shelf is disposed slightly beneath the door shelf. The shelf has an indication of the approximate location of the innermost extension of the door shelf when the door is closed. Preferably, the shelf includes graphical and/or textual indicia corresponding to the location of the door shelf when the door is closed, such as graphics shaped to follow the contour of the door shelf. The shelf can be transparent so that the indicia can be applied to the underside of the shelf by any suitable means such as etching, printing or adhesion. The shelf can also have an edge guard mounted to a front edge of the shelf that is contoured to correspond to the door shelf.

Still another aspect of the invention provides a refrigeration unit in which the door has a handle, framing and a floating face panel to which can be mounted an overlay panel for concealing the refrigeration unit. The handle and framing define a retaining lip extending around the perimeter of the face panel to retain the face panel in the door. Preferably, the handle includes upper and lower handle components, with the lower handle component defining a portion of the retaining lip. Filler material disposed behind the face panel biases the face panel against the retaining lip.

The foregoing and other objects and advantages of the invention will appear from the following description. In this description reference is made to the accompanying drawings which form a part hereof and in which there is shown by way of illustration preferred embodiments of the invention. Such embodiments do not necessarily represent the full scope of the invention, however, and reference must be made therefore to the claims for interpreting the scope of the invention.

BRIEF DESCRIPTION OF THE DRAWINGS

FIG. 20 is a perspective view of the door in isolation and the assembly of a door shelf;

FIG. 21 is a partial perspective view of an end of the door shelf within arc 21—21 of FIG. 20;

FIG. 22 is a partial side view of a boss mount for the door shelf within arc 22—22 of FIG. 20;

FIG. 23 is a partial top cross-sectional view taken along line 23—23 of FIG. 20;

FIG. 25 is a top view of a shelf looking down from line 25—25 of FIG. 2;

FIG. 26 is a side cross-sectional view taken along line 26—26 of FIG. 25, showing a food or beverage item in phantom;

DETAILED DESCRIPTION OF THE PREFERRED EMBODIMENTS

Figure 1:
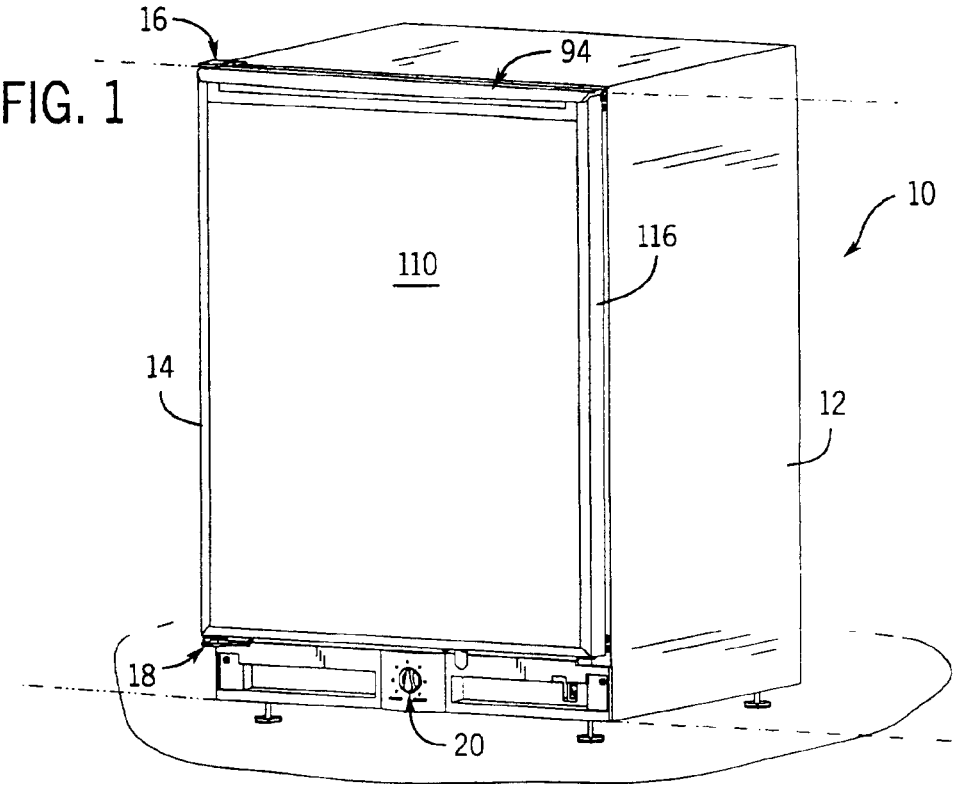
FIG. 1 is a front perspective view of the refrigeration unit of the present invention.

FIGS. 1–7 show a refrigeration unit 10, the term used herein to mean any self-contained storage unit, for example, a refrigerator, freezer and a wine or beverage cooler. The refrigeration unit 10 generally includes a thermally insulated cabinet 12 defining a storage cavity with an access opening at the front face of the cabinet 12. The opening is sealed by a thermally insulated door 14 pivotally mounted to the front of the cabinet 12 by upper 16 and lower 18 door hinge assemblies. Reversible door hinge assemblies mount the door 14 either to the left side (see FIGS. 1 and 2) or the right side (see FIGS. 3 and 4) of the cabinet 12. The refrigeration unit 10 includes a compressor, a capillary tube and interior and exterior heat exchanger coils containing a standard refrigerant, as known in the art, for lowering the temperature of the air inside the cabinet 12. The compressor, exterior coils and associated electronics are contained in a compartment in the bottom of the cabinet 12 accessible from the back side of the unit (see FIGS. 7 and 9). A thermostatic control 20 is provided to set the storage cavity air temperature to be maintained. The inside of the cabinet 12 is fit with an insert liner 22 supporting a plurality of shelves 24 (three are shown in the drawings) and defining a recess for a crisper drawer 26. The door 14 is also lined and includes a plurality of door shelves 28 (two are shown in the drawings). The perimeter of the door 14 mounts a flexible magnetic seal 27 typically used with conventional refrigerators.

Figure 8:
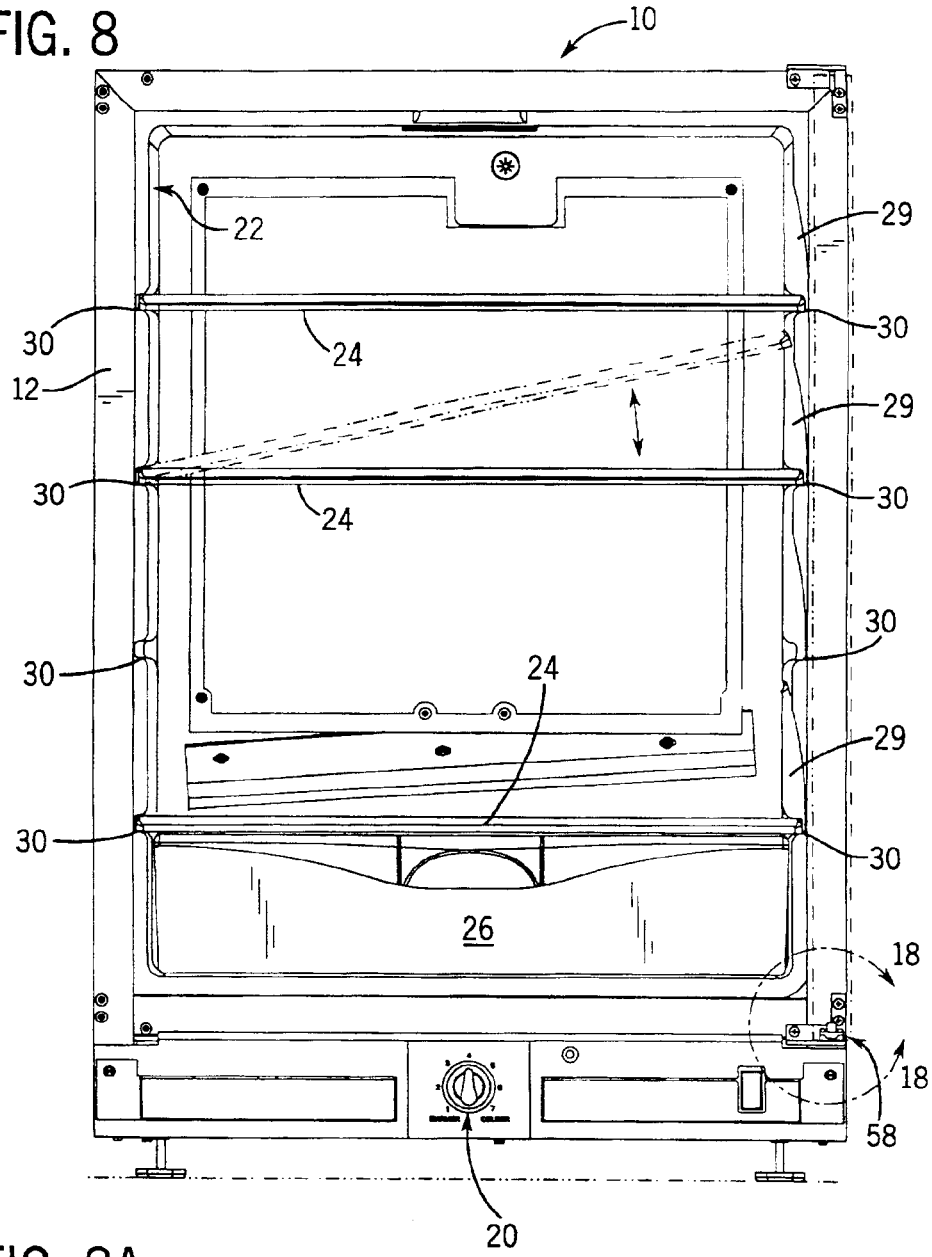
FIG. 8 is a front view of the refrigeration unit with the door removed.
Figure 8A:
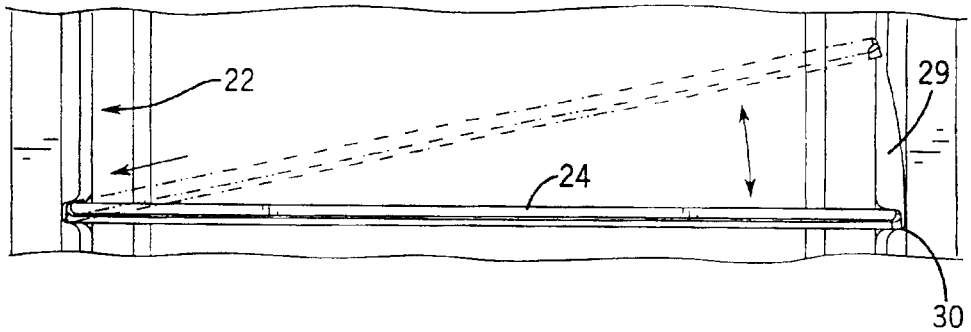
FIG. 8A is an enlarged view of a shelf and a scooped portion of a liner.

Turning now to FIGS. 8–8A, a unique feature of the refrigeration unit 10 of the present invention is that the shelves 24 can be dislocated from their horizontal resting position for removal or repositioning within the cabinet 12 without requiring the door 14 to be swung completely clear of the front of the door opening. That is the shelves 24 can be repositioned or removed with the door 14 opened approximately 90 degrees. The liner 22 is formed with aligned pairs of rests 30 supporting opposite side edges of the shelves 24. On one side (the right side in the drawings), the liner 22 is formed with a dished or scooped recesses 29 extending up from outer edges of the shelf rests 30. The recesses 29 extend from the access opening at the front of the cabinet 12 back a distance less than the length of the corresponding edges of the shelves 24. As shown in FIG. 8A, this allows the right side of the shelves 24 to be freely lifted and pivoted up along the opposite side of the shelf resting on the opposite rest 30 when each shelf is pulled out slightly so that the back end of the shelf 24 is just in front of the back of the recess 29. Each shelf 24 can be pivoted until its effective lateral dimension is less than that of the inside of the cabinet 12, between lateral sides of the liner 22, and the pivot edge of the shelf 24 can be dislocated from its rest 30. Each shelf 24 then can be removed from the cabinet 12 for cleaning or remounted at a different height by reversing the steps for removing the shelf 24.

Another unique feature of this refrigeration unit pertains to the mounting of upper and lower door shelves 28, shown in FIGS. 2–4, 9 and 20–23. The door shelves 28 have a bottom and a generally U-shaped side rail 32 having a front and opposite ends 34 extending away from the cabinet 12 generally perpendicular to the door 14. Each end 34 is formed with a raised track 36. The tracks 36 open at the terminal end of the side rail 32 and extend forward first in a straight path and then upward at approximately 45 degrees to closed ends. The tracks 36 have inwardly extending nibs 37 that decreases the width of each track at the bend. The tracks 36 are designed to receive a pair of boss mounts 38 extending inwardly from shelf support uprights 40 formed in a door liner 42. The door shelves 28 can thus be mounted to the door 14 by aligning the openings in the tracks 36 with the boss mounts 38 and pushing the door shelf 28 toward the door 14 until the closed end of the tracks 36 rest on the boss mounts 38. The door shelves 28 can be removed by pivoting them upward and pulling them away from the door 14 to pass the nibs 37 by the mounts 38. The nibs 37 act to capture the boss mounts 38 in the tracks 36 and thereby inhibit inadvertent dislocation of the door shelves 28.

As shown in FIG. 20, the shelf support uprights 40 preferably include three sets of boss mounts 38 at different heights of the door 14. The top two sets of boss mounts 38 are used allow the upper door shelf to be repositioned or to mount two such door shelves. Also, it should be noted that the shelf support uprights 40 are of increased depth at the bottom ends. The door liner 42 also is formed with a small ledge 44 that combines with the bottom of the door shelf 28 to form a deeper overall shelf. Still further, the door liner 42 is formed with a dished bottle recess 46 to accommodate large bottles, such as standard 2-liter soda bottles.

Figure 9:
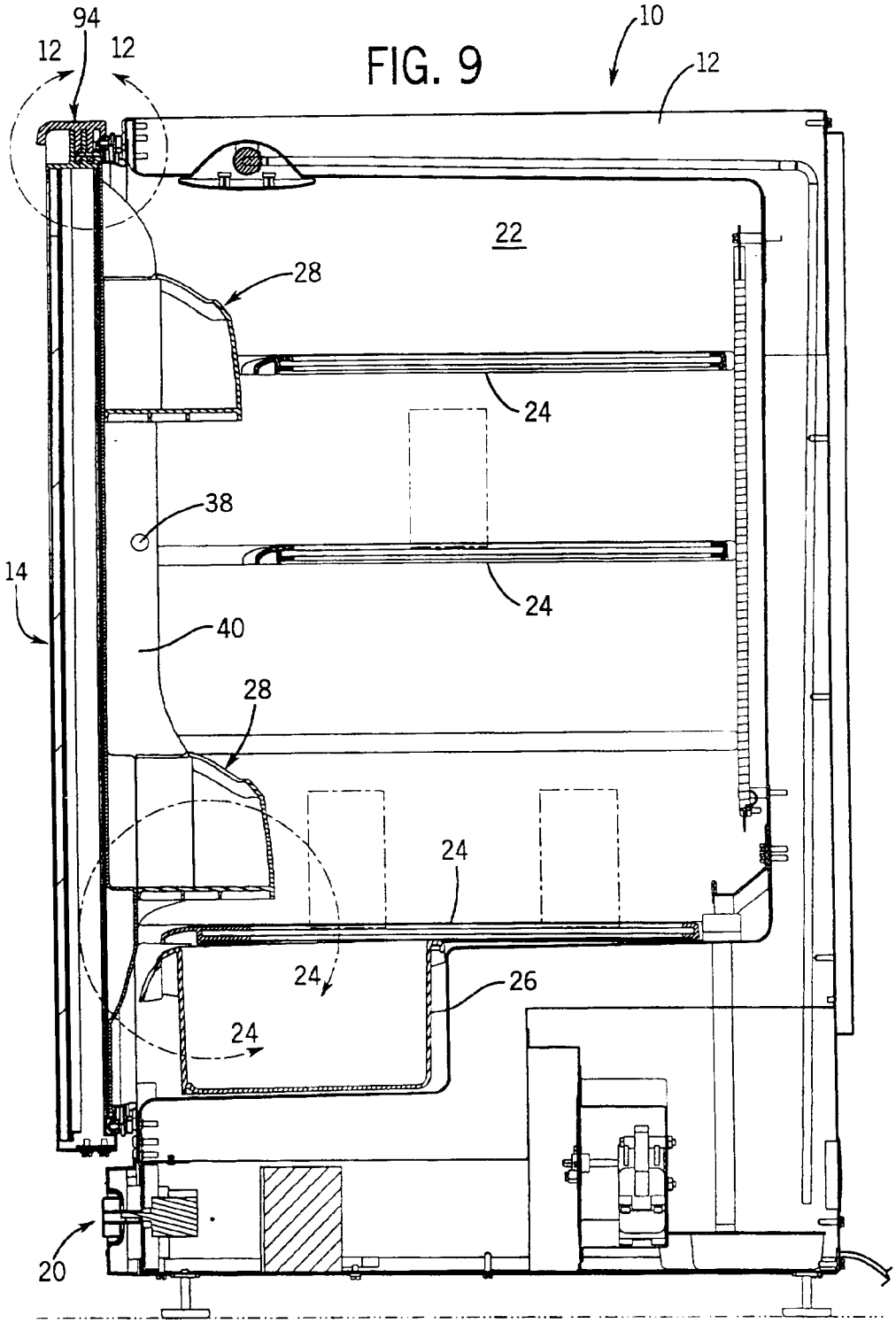
FIG. 9 is a side cross-sectional view taken along line 9—9 of FIG. 5.
Figure 24:
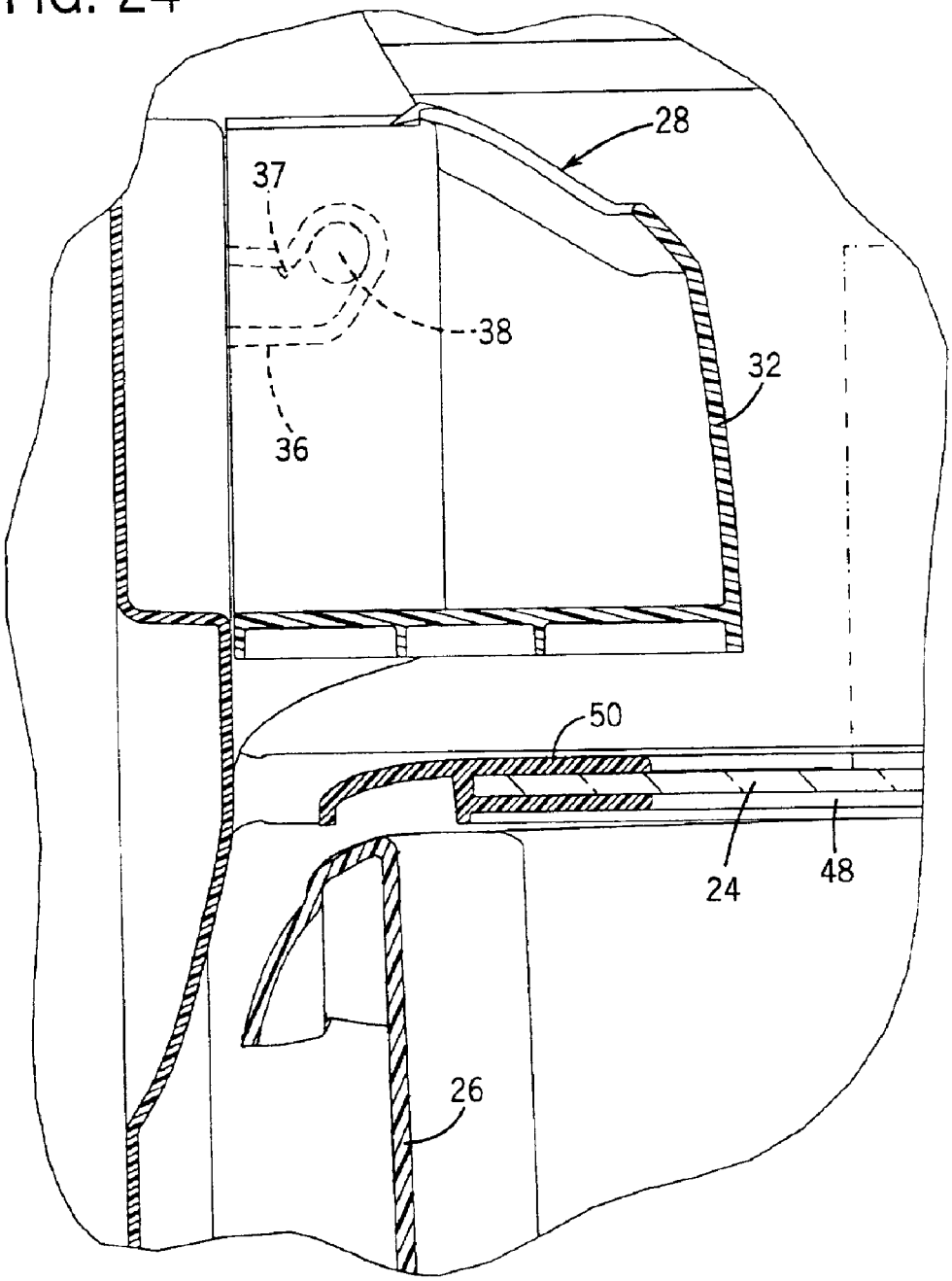
FIG. 24 is a partial side cross-sectional view within arc 24—24 of FIG. 9.

Referring now to FIG. 9, the upper shelves 24 are sized small enough not to interfere with the upper door shelf 28 when the door 14 is closed. However, the bottom shelf 24 is larger because it acts as a cover for the crisper drawer 26 (see also FIG. 24). The bottom shelf would extend into the space occupied by the bottom door shelf 28 if they were not at a different heights. As shown in FIGS. 25–26, the bottom shelf has a raised edge guard 48 around its perimeter that includes a contoured portion 50 corresponding to the side wall 32 of the bottom door shelf 28. Adjacent the contoured portion 50 is indicia 52 similarly contoured and indicating approximately the innermost extension of the bottom door shelf 28. This indicia 52 is preferably graphics and/or text formed at the underside of the bottom shelf by a suitable printing or etching process. The indicia 52 thus provides visual notification that items should not be stored beyond that point so as not to interfere with the closure of the door 14. The bottom shelf and the door shelf thus cooperate to avoid the refrigeration unit 10 from being used in a way that results in the stored items being damaged or the door 14 being left ajar.

Another aspect of the refrigeration unit of the present invention is that the door hinges include a unique cam assembly that provides a door close-assist feature. Referring to FIGS. 16–19B, the lower door hinge assembly 18 includes an L-shaped lower pivot bracket 54 that mounts to the front face of the cabinet 12 by three bolts to support the bottom end of the door 14. The lower door hinge assembly 18 also includes a rectangular mounting plate 56 that mounts to the underside of bottom corner of the door 14 with two bolts inserted through two slots 57 that allow for adjustment of the position of the mounting plate 56 with respect to the door. A cam assembly 58 mounts between the bracket 54 and the mounting plate 56. The cam assembly 58 includes an upper cam 60 and a lower cam 62. The upper cam 60 has a face surface that defines two raised plateaus 64 and two smaller recessed valleys 66 between which are two sets of ramp surfaces 68. The lower cam 62 has a face surface that defines two raised plateaus 65 sized to fit in the valleys 66 of the upper cam 60 and two recessed valleys 67 between which are two sets of ramp surfaces 69. The back side of each cam 60 and 62 has a pair of key pins 70 that are disposed 180 degrees apart. Each cam 60 and 62 also has an axial opening 72 therethrough and the upper cam 60 also defines a cylindrical sleeve member 74 at the back side. The pins 70 of the lower cam 62 fit into a pair of keyways 76 at the tip of bracket 54 attached to the cabinet 12. Similarly, the pins 70 of the upper cam 60 fit into a pair of keyways 78 at the outer end of the mounting plate 56 on the door 14, the sleeve member 74 fits through a larger opening 80 (see FIG. 19B). The pins 70 prevent the cams 60 and 62 from rotating with respect to the mounting plate 56 and the bracket 54, respectively. The cams 60 and 62 are mounted 90 degrees offset from each other so that the plateaus of one cam engage the valleys of the other cam when the door 14 is closed. The cams 60 and 62 are held together by gravity under the weight of the door 14 and a hinge pin 82 that extends along a pivot axis through the axial openings 72 in the cams (and the sleeve member 74 in the upper cam 60). The hinge pin 82 has an enlarged head that threads into a threaded opening 84 in the bracket 54.

Figure 10:
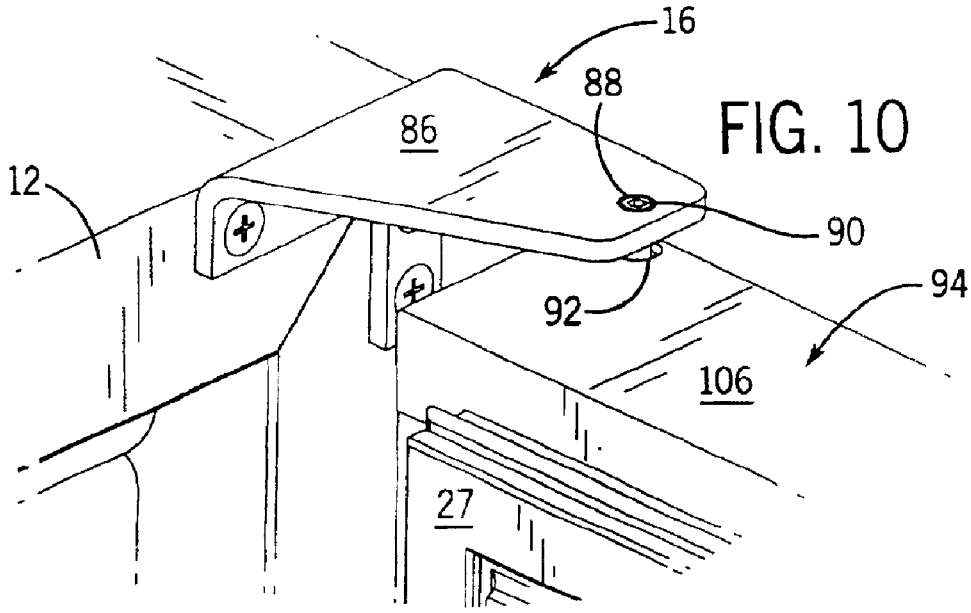
FIG. 10 is a partial front perspective view of an upper door hinge assembly with the door opened.
Figure 16:
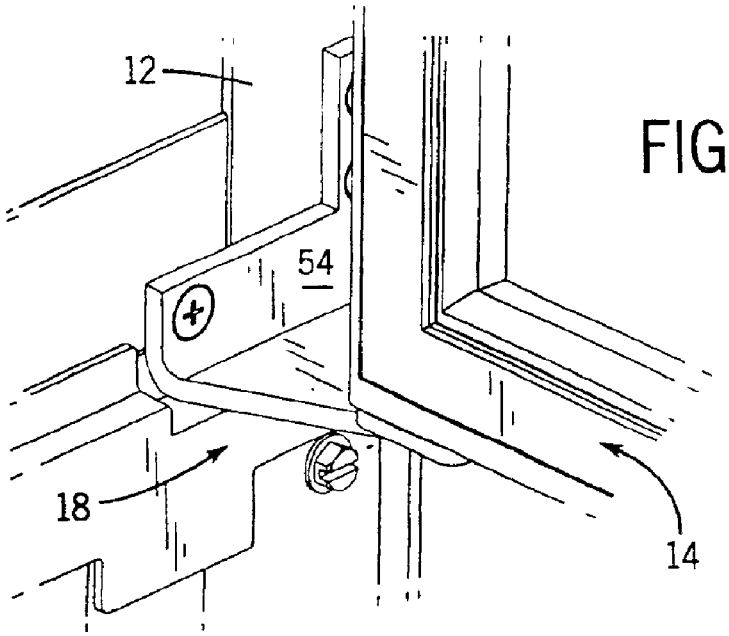
FIG. 16 is a partial front perspective view of a lower door hinge assembly with the door opened.
Figure 11:
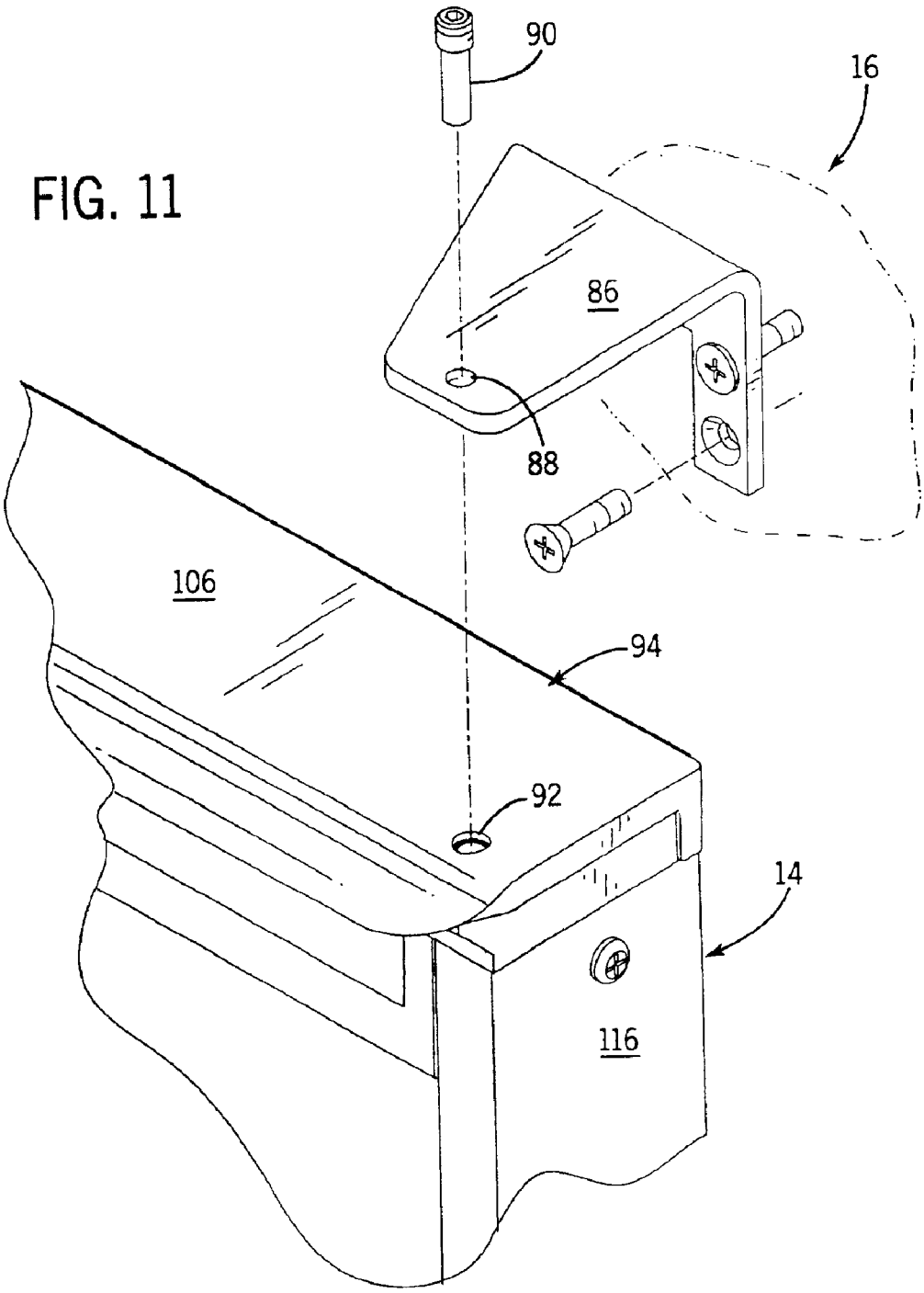
FIG. 11 is a partial exploded assembly view of the upper door hinge assembly.

Referring to FIGS. 10 and 11, the upper door hinge assembly 16 has an upper pivot bracket 86 that mounts to the front face of the cabinet 12 by three bolts. The bracket 86 includes an opening 88 in which a hinge pin 90 is inserted along the pivot axis to fit within an opening 92 in a handle 94 at the top of the door 14. The pin 90 has an enlarged threaded head that threads into the opening 88 to secure it to the bracket 86. The bracket 86 is spaced a distance from the top of the handle to allow the door 14 to float between the upper 86 and lower 54 brackets and be raised and lowered as needed when being opened and closed.

As mentioned, this arrangement helps to close the door 14. Specifically, as the door 14 is opened from the closed position, it pivots about the pivot axis extending through the hinge pins 82 and 90. This causes the upper cam 60 to rotate with respect to the lower cam 62. As it does, opposing ramp surfaces 68 and 69 engage and cause upward axial translation of the upper cam 60 (and thus the door 14). The raised position of the door 14 is opposed by gravity which will bias the upper cam 60 to rotate back to its initial position (in the absence of a counter-acting force) when the ramp surfaces 68 and 69 are engaged. Thus, the cam assembly 58 biases the door 14 closed when partially open, for example, 25 to 35 degrees or when the free edge of the door 14 is approximately eight to ten inches from the cabinet 12. When the door 14 is swung open far enough, approximately 60–90 degrees, the cams 60 and 62 will engage at the raised plateaus 64 and 65. Since these surfaces are flat, friction will keep the door 14 at this opened position in the absence of an external force (either opening the door 14 further or closing it). In this way, the cam assembly 58 also helps hold the door 14 open.

Figure 2:
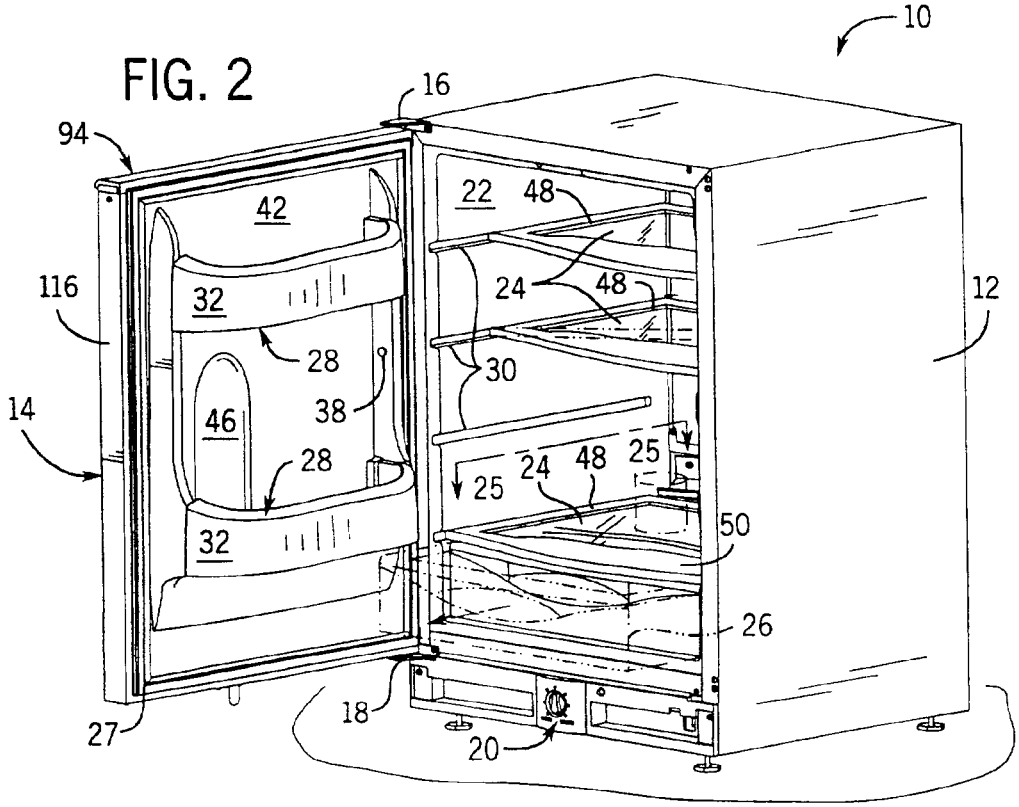
FIG. 2 is a perspective view of the refrigeration unit similar to FIG. 1 albeit with its door shown opened.
Figure 3:
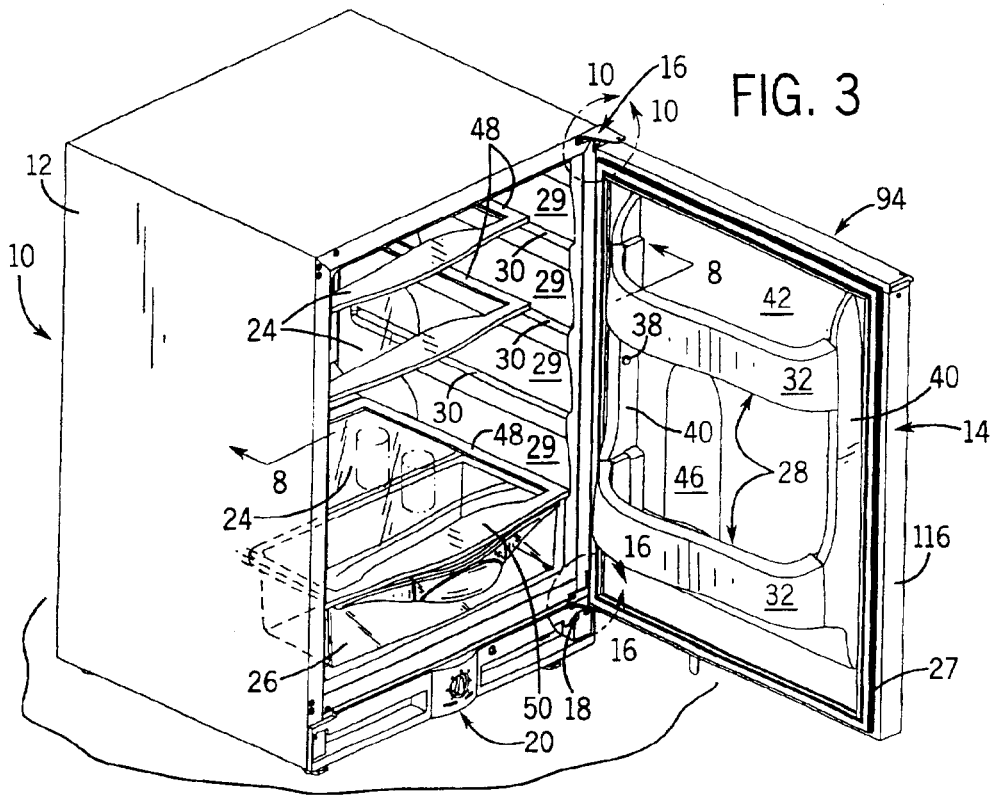
FIG. 3 is a perspective view of the refrigeration unit with the door hinged at the right side of the refrigeration unit and opened.
Figure 4:
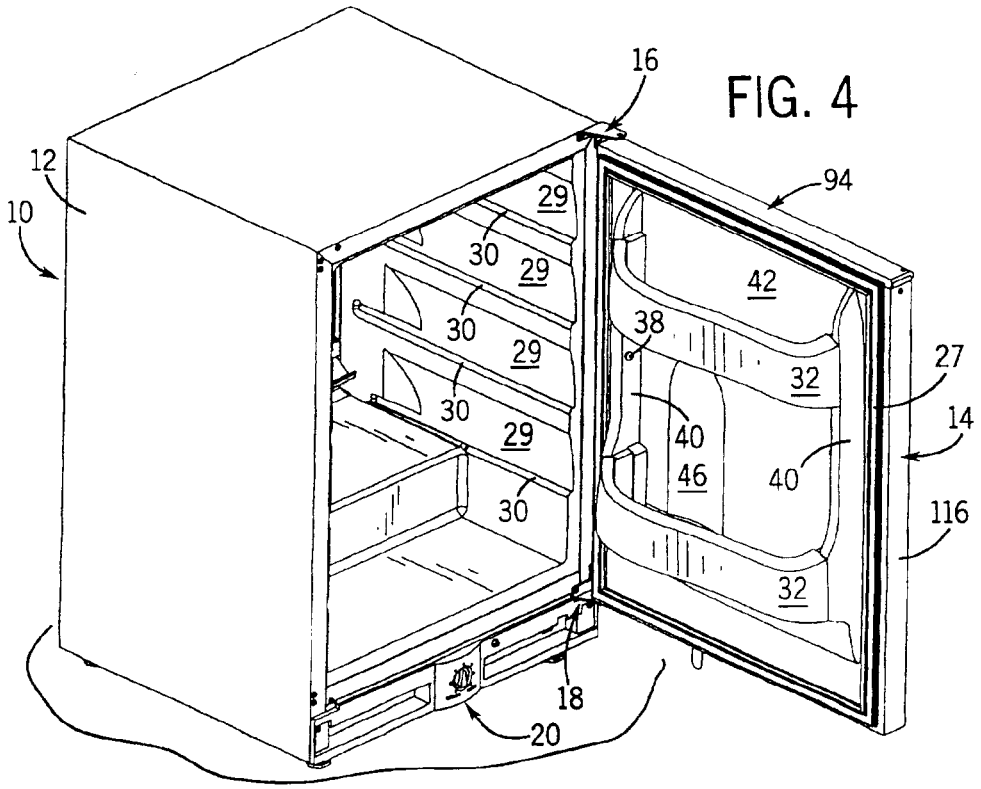
FIG. 4 is a perspective view similar to FIG. 3 albeit with the shelves and crisper shown in FIG. 3 removed.
Figure 5:
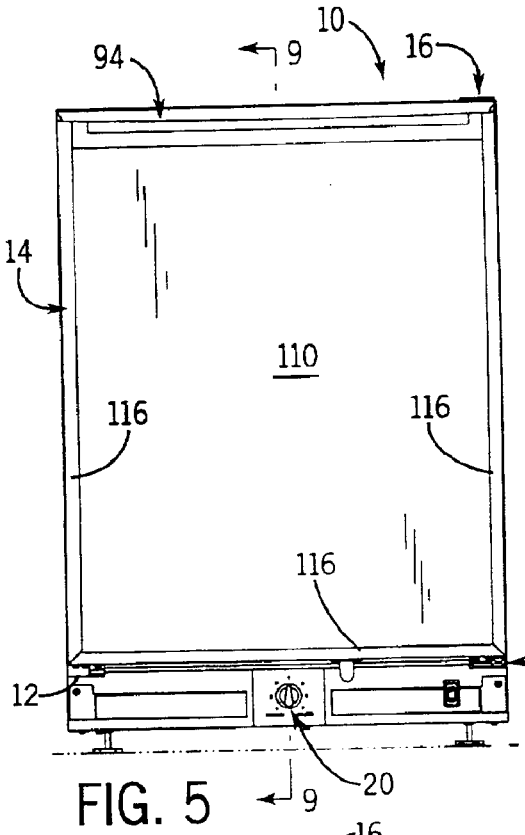
FIG. 5 is a front plan view thereof with the door closed.
Figure 6:
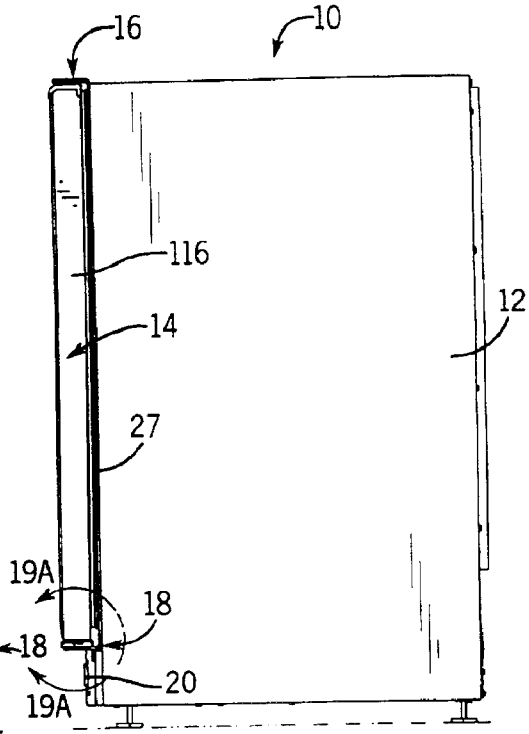
FIG. 6 is a right side view thereof.
Figure 7:
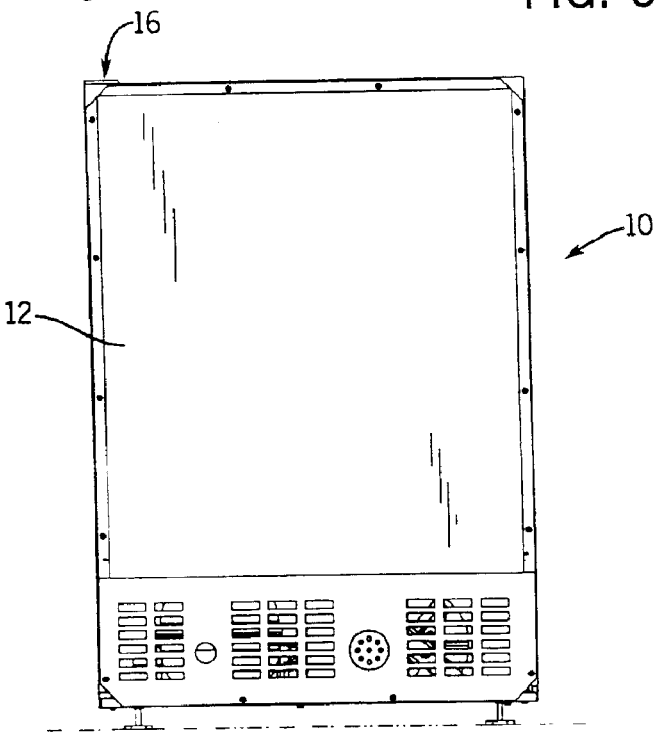
FIG. 7 is rear view thereof.
Figure 27:
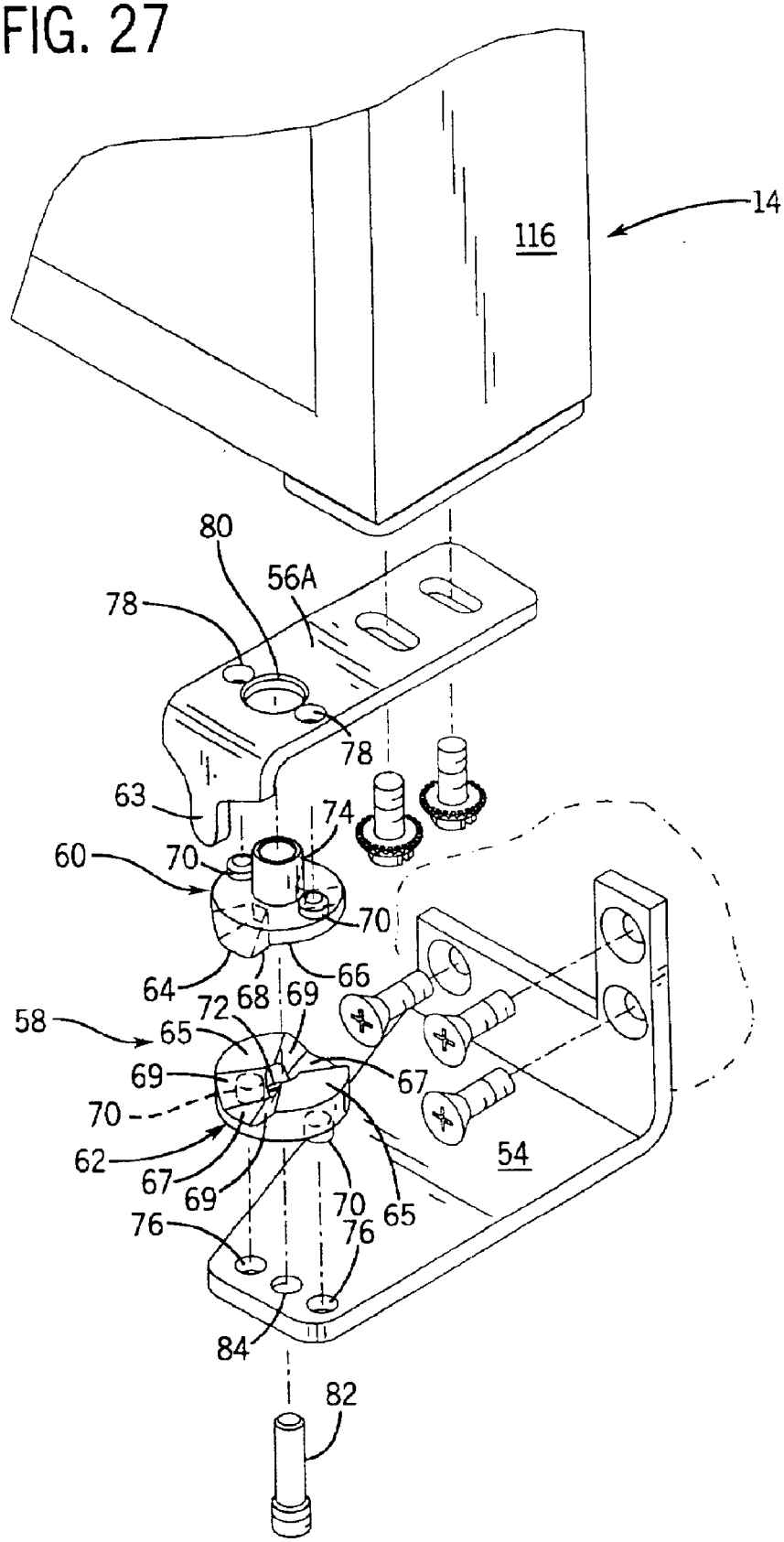
FIG. 27 is an exploded view of an alternate hinge assembly with a pivot stop.
Figure 28:
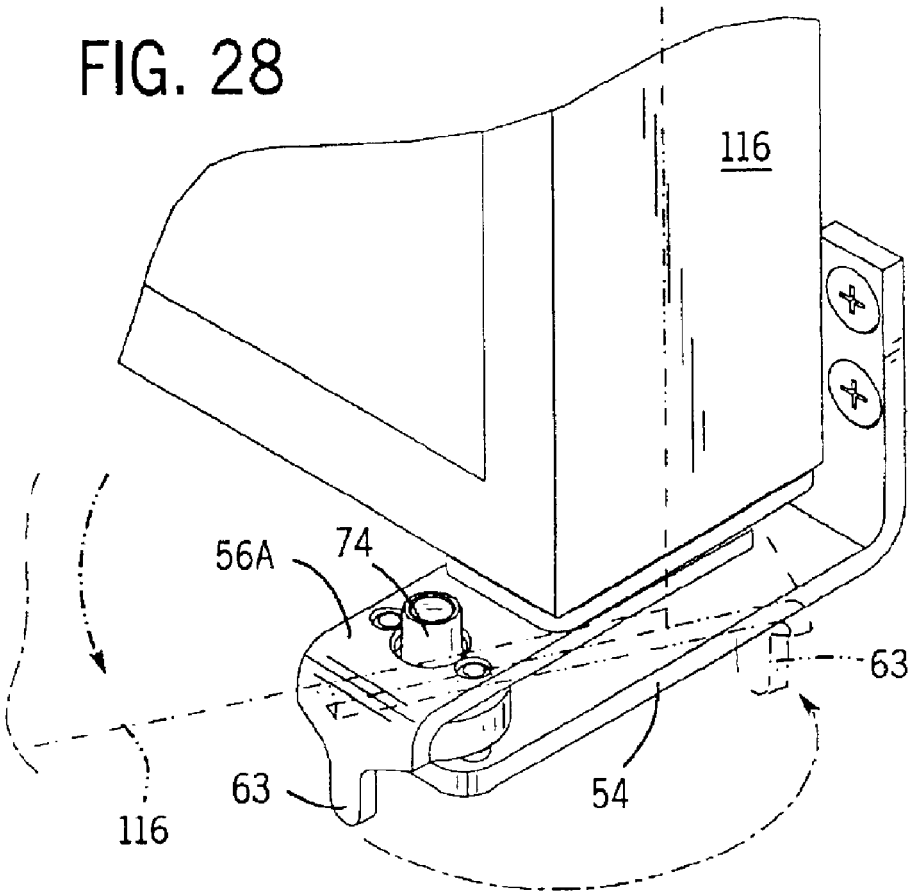
FIG. 28 is a cross-section view showing the hinge assembly of FIG. 27 with the door in a fully open position in which the stop member abuts a mounting bracket to prevent further rotation of the door.

Also, as shown in FIGS. 2 and 3, the door can be mounted to either side of the cabinet using the same hinge assemblies. The hinge assemblies are reversible in that the lower bracket 54 (see FIG. 17) and the upper bracket 86 (see FIG. 11) for the right-side mounted door of FIG. 3 can be interchanged and mounted to the left side of the cabinet for the left-side mounted door of FIG. 2. Thus, only one set of hinge assembles is needed to change the pivot of the door. Additionally, the one of the hinge assemblies can be made to include a stop member. In one embodiment, as shown in FIGS. 27–28, the mounting plate 56A can have an increased length with a downwardly depending stop member 63. The stop member 63 is disposed in front of (and spaced from) the lower mounting bracket 54 when the door is closed. As the door is opened, the stop member 63 swings around the front right comer of the bracket 54 (the left front comer for a left-side mounted door). At some angle, for example 85 degrees, the stop member 63 abuts the right edge of the bracket 54 so as to prevent further rotation of the door.

Figure 13:
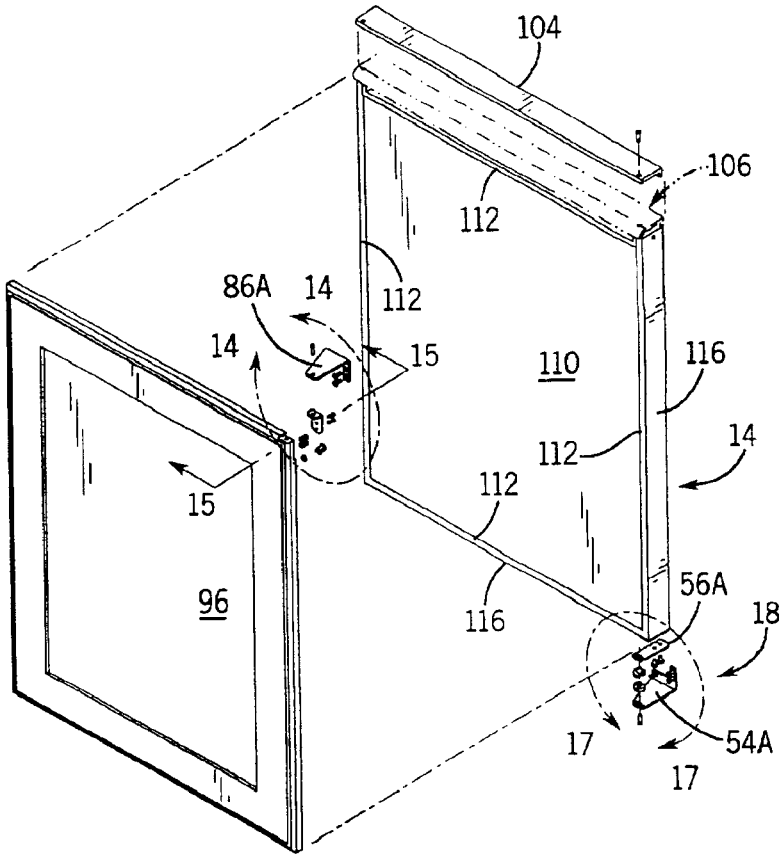
FIG. 13 is an exploded assembly view of the door including an overlay panel, a handle and the upper and lower door hinge assemblies.
Figure 15:
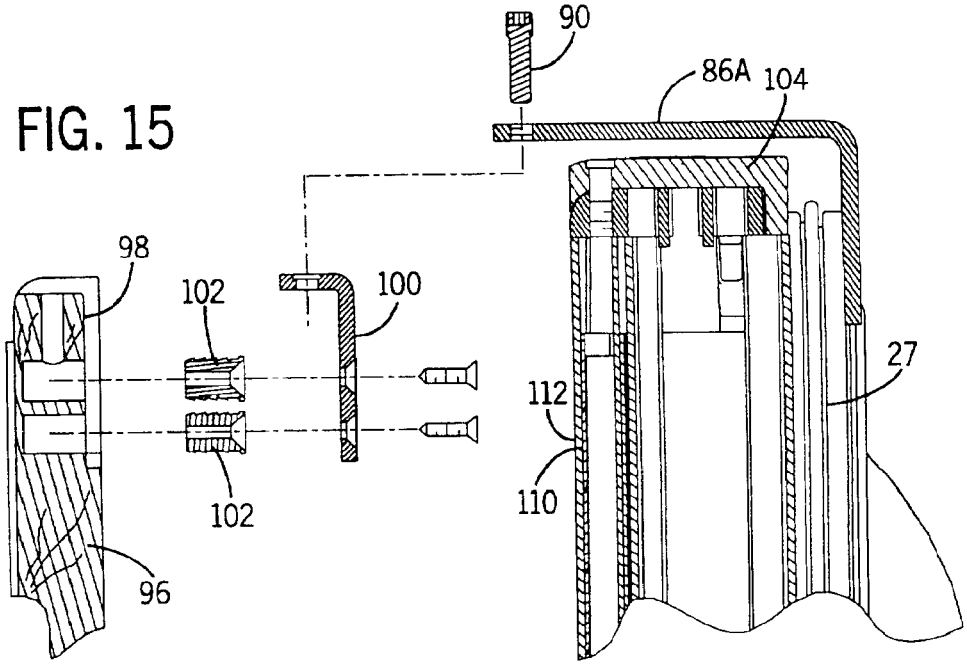
FIG. 15 is a side cross-sectional assembly view taken through line 15—15 of FIG. 13.
Figure 14:
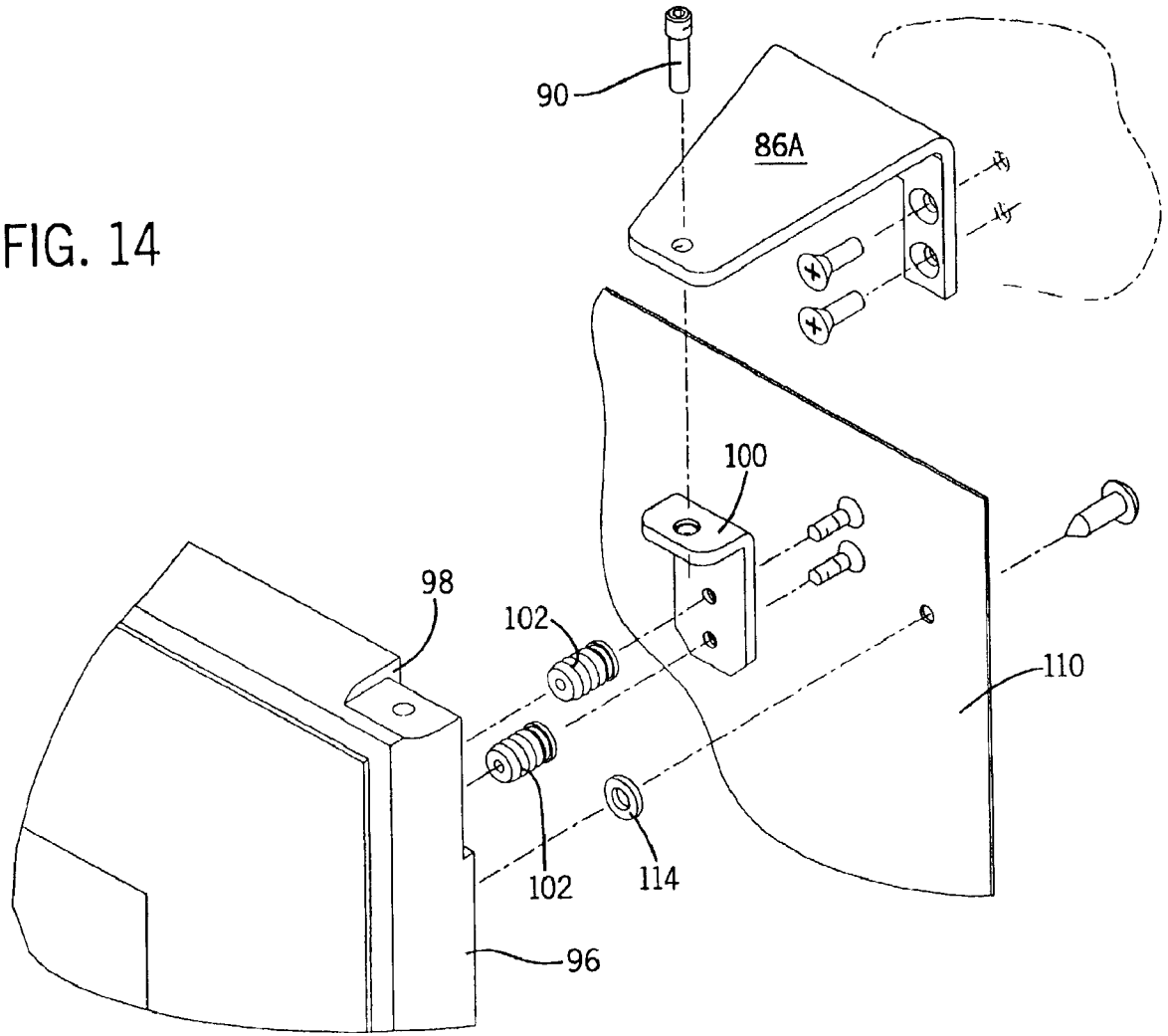
FIG. 14 is an enlarged partial exploded assembly view within arc 14—14 of FIG. 13.
Figure 17:
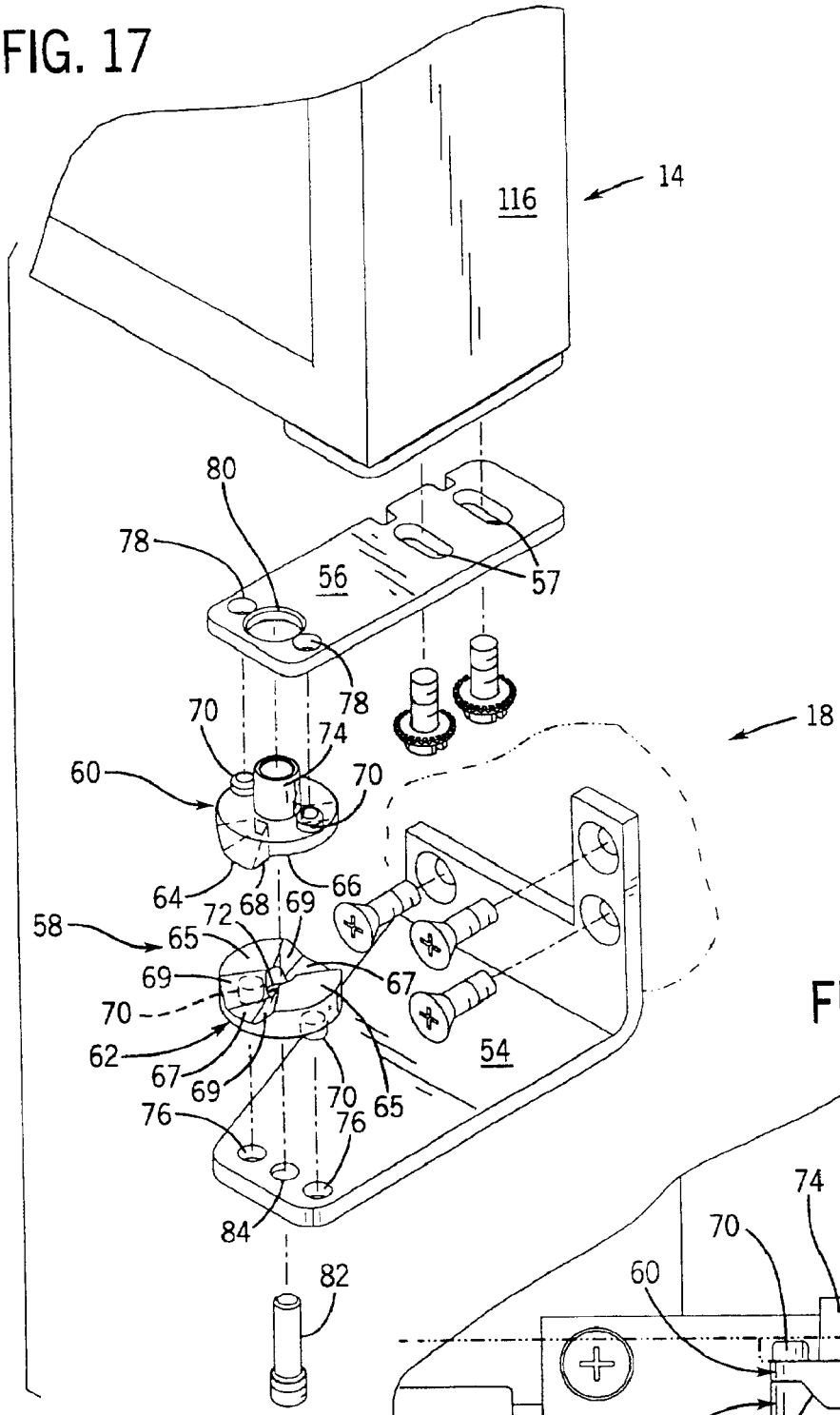
FIG. 17 is a partial exploded perspective view within arc 17—17 of FIG. 13.
Figure 18:
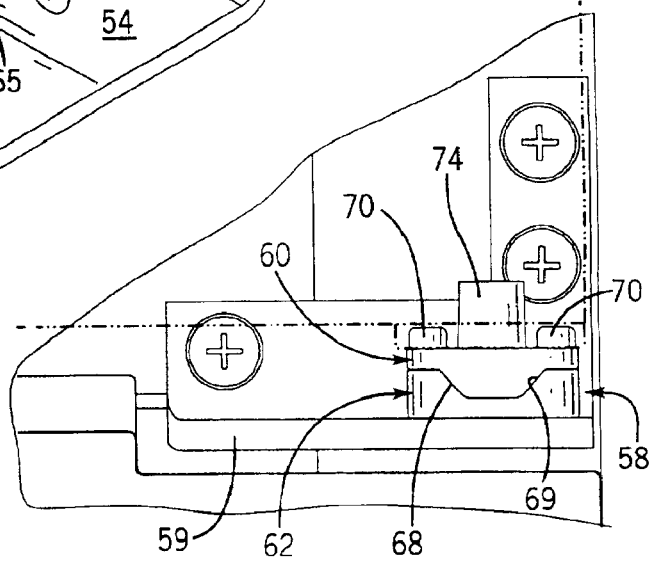
FIG. 18 is a partial front view of the assembled lower door hinge assembly including a door cam assembly.
Figure 19B:
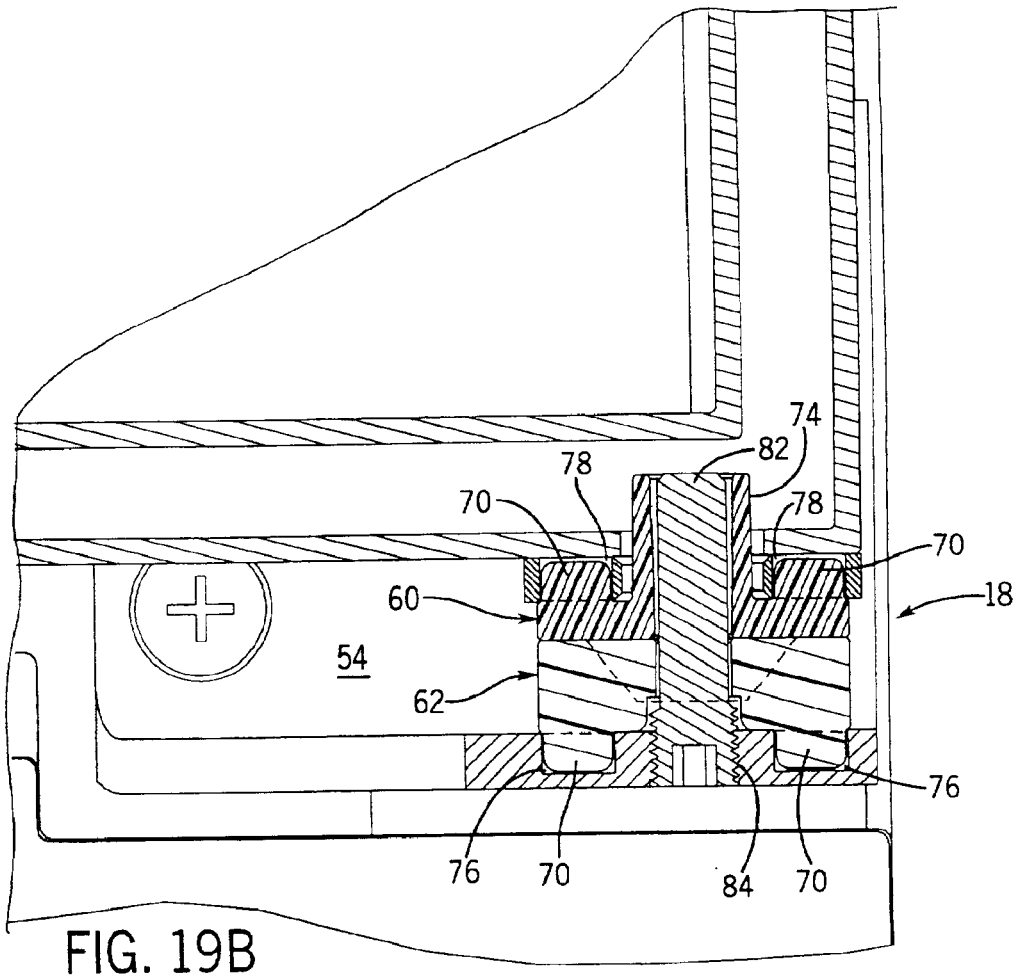
FIG. 19B is front cross-sectional view taken along line 19B—19B of FIG. 19A.
Figure 19A:
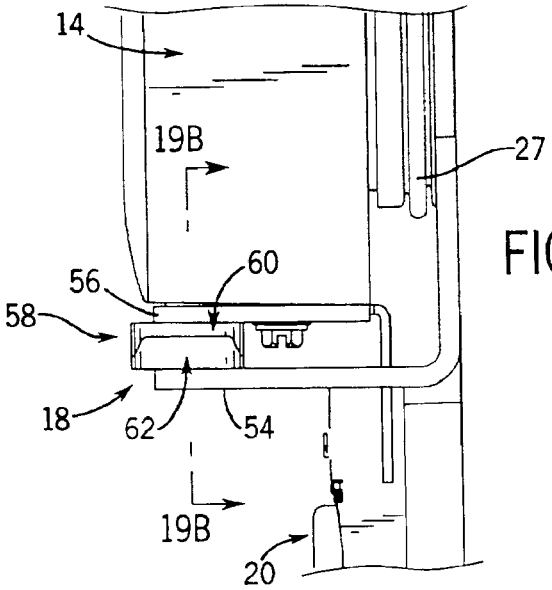
FIG. 19A is a partial right side view showing the lower door hinge assembly.

Referring to FIGS. 13–15, the refrigeration unit 10 of the present invention also provides easy attachment of an overlay panel 96 to the door 14 that can be made of a material and design that matches neighboring cabinetry, thereby concealing the refrigeration unit. When an overlay panel 96 is to be mounted to the door 14, deeper upper 86A and lower 54A pivot brackets and mounting plate 56A are used to increase the pivot radius and accommodate for the added thickness of the door so that the overlay panel 96 so that the door 14 can maintain zero clearance with an adjacent wall or cabinet so that the comer of the panel 96 next to the hinge does not swing out and interfere with the adjacent wall or cabinet. This also requires the upper hinge pin 90 to be disposed in a recess in 98 the overlay panel 96. Since the overlay panel 96 is most often made of wood, a metal L-bracket 100 is used to add support at the pivot connection. The recess 98 is sized to receive the L-bracket so that it is flush with the back side of the overlay panel 96. Threaded inserts 102 can be used to mount the L-bracket 100 to the overlay panel 96.

Figure 12:
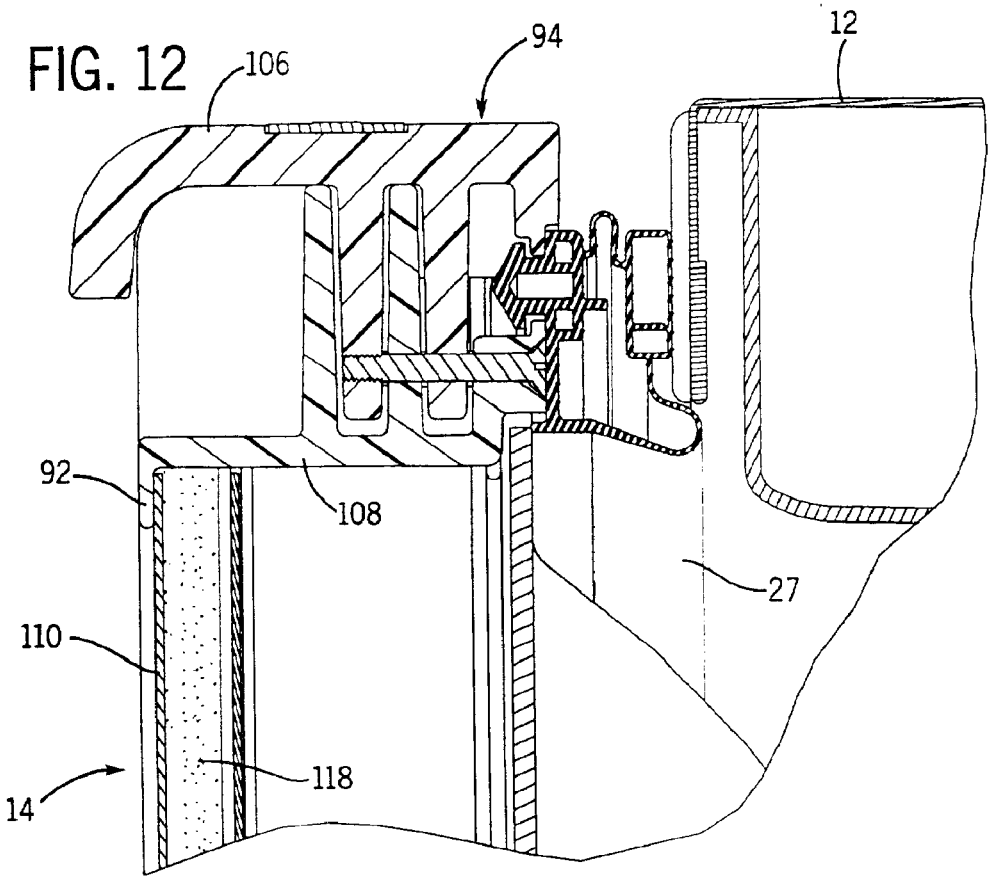
FIG. 12 is an enlarged partial side cross-sectional view within arc 12—12 of FIG. 9.

Because overlay panels 96 are designed to match the stain and ornamental elements of neighboring cabinetry, they are ordinarily assembled in the field. Thus, a kit including the larger hinge assemblies and a modified upper handle component 104 can be purchased and installed onto the unit. To do this, the hinge pins 82 and 90 are removed and the door 14 is dismounted from the cabinet 12. The original door hinge assemblies are removed and the supplied larger door hinge assemblies are mounted to the cabinet 12 and the L-bracket 100 is installed onto the back side of the overlay panel 96. The original upper 106 and lower 108 components of the handle 94 are then unscrewed from the door 14. This permits a floating face panel 110 to be slid up and disengaged from a retaining lip 112 defined by the inner edge of the lower handle component 108 and door framing 116. As shown in FIG. 12, the face panel 110 is held against the lip 112 by filler material 118, such as cardboard. The face panel 110 then can be screwed onto the back of the overlay panel 96 with spacers 114 providing a gap therebetween to accommodate for the thickness of the lip 112. The overlay panel 96 and face panel 110 assembly can then be reattached to the door 14 by sliding the face panel 110 behind the lip 112. The lower handle component 106 then can be reattached with its lip disposed between the back side of the overlay panel 96 and the front side of the face panel 108. The supplied upper handle component 104 can then be fastened to the lower handle component 108. This upper handle component 104 is identical to the original upper handle component 106, however, the curved grip area has been removed so the handle is flush with the front of the door 14 and does not interfere with the overlay panel 96. Since the lip has been removed and the handle is covered by the overlay panel 96, a separate pull (not shown) can be fastened to the front or side of the overlay panel 96. The pull can, for example, match that of neighboring cabinetry.

In one preferred embodiment, the cam elements 60 and 62 are preferably nylon or other low-friction, lubricious material, such as Delrin® or Celcon® and the hinge brackets and pins are steel. The liner 22 and the door liner 42 are made of thermoformed high impact polystyrene. The door shelves 28 are a durable injection molded plastic, such as ABS. The shelves 24 are a transparent, tempered glass with an ABS plastic edge guard 48. The crisper drawer 26 is a clear hard plastic. The face panel 110 of the door 14 is a vinyl clad sheet steel and the framing is a very hard extruded plastic. The upper handle component 106 (and 104) are a rigid thermoset plastic and the lower handle component 108 is an injection molded plastic.

Illustrative embodiments of the invention have been described in detail for the purpose of disclosing a practical, operative structure whereby the invention may be practiced advantageously. However, the apparatus described is intended to be illustrative only, and the novel characteristics of the invention may be incorporated in other structural forms without departing from the scope of the invention. Accordingly, to apprise the public of the full scope of the invention, the following claims are made:

What is claimed is:

1. A refrigeration unit having a cabinet defining a storage cavity open at a front side covered by a door mounted to the front of the cabinet by two hinge assemblies at least one of which includes first and second mounting brackets spaced apart along a pivot axis on each side of a cam assembly including:

a first cam having an undulating face surface including at least one oblique ramp surface and having an opposite back surface defining a key member engaging a corresponding key member of the first mounting bracket to prevent movement of the first cam member with respect to the first mounting bracket; and a second cam having a complementary undulating face surface with at least one ramp surface and being matable with the face surface of the first cam, the second cam also having an opposite back surface defining a key member engaging a corresponding key member of the second mounting bracket to prevent movement of the second cam with respect to the second mounting bracket;

wherein the first cam can rotate with respect to the second cam when the door is opened and closed such that engagement of the opposing ramp surfaces biases the door toward the cabinet;

wherein the second mounting bracket includes a stop member disposed to be in abutting relation with the first mounting bracket at a fully open position of the door so as to prevent further rotation of the door about the pivot axis.

2. The refrigeration unit of claim 1, wherein the key members of the first and second cams are axially extending pins and the key members of the first and second mounting brackets are keyway openings sized to receive the pins.

3. The refrigeration unit of claim 1, wherein the first and second cams are made of a low friction, lubricious material.

4. The refrigeration unit of claim 1, wherein the first cam has two radially spaced ramp surfaces aligned for engagement with two radially spaced ramp surfaces of the second cam.

5. The refrigeration unit of claim 1, further including a hinge pin disposed along the pivot axis through axial openings in the first and second cams.

6. The refrigeration unit of claim 5, wherein the back side of the second cam defines a sleeve aligned with the axially opening receiving the hinge pin and extending through an opening in the second mounting bracket.

7. The refrigeration unit of claim 1, wherein the second mounting bracket is a flat plate mounted to the door for rotation about the pivot axis.

8. A refrigeration unit having a cabinet defining a storage cavity open at a front side covered by a door mounted to the front of the cabinet by two hinge assemblies at least one of which includes first and second mounting brackets spaced apart along a pivot axis on each side of a cam assembly including:

a first cam having an undulating face surface including at least one oblique ramp surface and having an opposite back surface defining a key member engaging a corresponding key member of the first mounting bracket to prevent movement of the first cam member with respect to the first mounting bracket; and a second cam having a complementary undulating face surface with at least one ramp surface and being matable with the face surface of the first cam, the second cam also having an opposite back surface defining a key member engaging a corresponding key member of the second mounting bracket to prevent movement of the second cam with respect to the second mounting bracket;

wherein the first cam can rotate with respect to the second cam when the door is opened and closed such that engagement of the opposing ramp surfaces biases the door toward the cabinet;

wherein the key members of the first and second cams are axially extending pins and the key members of the first and second mounting brackets are keyway openings sized to receive the pins;

wherein each of the first and second cams and the first and second mounting brackets includes two key members.

9. A refrigeration unit, comprising a cabinet defining a storage cavity open at a front side covered by a door mounted to the front of the cabinet, wherein the door has an inner surface defining at least one pair of vertically aligned shelf support mounts, wherein the shelf support mounts support at least one door shelf comprising a bottom and a side rail with opposite ends extending generally perpendicular to the door defining a pair of shelf mounts for engaging the shelf support mounts such that the door shelf can be detached from the shelf support mounts by tilting a side of the door shelf toward the door and moving the door shelf away from the door, wherein the shelf support mounts or the shelf mounts are tracks defining angled pathways having open-ended straight paths and closed paths angling from the straight paths, and wherein at least one of the tracks has an inwardly extending nib narrowing the associated pathway at the junction of the associated straight and angled paths so as to removably capture the associated shelf mount or shelf support mount in the closed end of the associated track.

10. The refrigeration unit of claim 9, wherein the inner surface of the door is defined by an insert liner.

11. The refrigeration unit of claim 10, wherein the insert liner is a thermoformed plastic.

12. The refrigeration unit of claim 10, wherein the shelf support mounts includes a pair of laterally spaced uprights.

13. The refrigeration unit of claim 12, wherein the uprights include the shelf support mounts.

14. The refrigeration unit of claim 13, wherein the shelf support mounts are laterally extending bosses and the shelf mounts are tracks sized to receive the shelf support mounts.

15. The refrigeration unit of claim 14, wherein the tracks have an open end toward the terminal ends of the door shelf side rail ends, the tracks define a straight portion adjacent the open end and an angled portion extending at an oblique angle from the straight portion to a closed end.

16. A refrigeration unit, comprising:

a cabinet defining a storage cavity having an access opening in a face of the cabinet;

a door hinged to the cabinet face to cover the access opening, the door having a door shelf with a curved profile extending into the storage cavity; and a planar shelf supported by the cabinet in a lateral orientation within the storage cavity such that a front portion of the shelf is disposed beneath the door shelf, the shelf including a visual indicator of the approximate location of the innermost extension of the door shelf when the door is closed, wherein the visual indicator defines a curve approximating the profile of the door shelf.

17. The refrigeration unit of claim 16, wherein the indicator includes at least one of graphic and text indicia corresponding to the location of the door shelf when the door is closed.

18. The refrigeration unit of claim 17, wherein the shelf is transparent and the indicia is located at the underside of the shelf.

19. The refrigeration unit of claim 18, wherein the indicia is applied by one of etching and printing.

20. A refrigeration unit, comprising:

a cabinet defining a storage cavity having an access opening in a face of the cabinet;

a door hinged to the cabinet face to cover the access opening, the door having a door shelf extending into the storage cavity; and a planar shelf supported by the cabinet in a horizontal orientation within the storage cavity such that a front portion of the shelf is disposed beneath the door shelf, the shelf including a visual indicator of the approximate location of the innermost extension of the door shelf when the door is closed;

wherein the indicator includes at least one of graphic and text indicia corresponding to the location of the door shelf when the door is closed;

wherein the door shelf has a contoured profile and the indicia has a corresponding contour;

wherein the shelf includes an edge guard mounted at a front edge of the shelf having a contoured inner edge corresponding to that of the door shelf.

21. A refrigeration unit, comprising:

a cabinet defining a storage cavity with an access opening at a face of the cabinet; and a door hinged to the cabinet face to cover the access opening, the door having a top member, framing, a floating face panel and an overlay panel mounted to the face panel for concealing the cabinet, wherein the framing defines a retaining lip extending around at least a portion of the perimeter of the face panel disposed within a gap between the overlay panel and the face panel so as to retain the face panel in the door;

wherein the top member includes upper and lower components, the lower component defining a lip extending downwardly past a top edge of the face panel.

22. A refrigeration unit, comprising:

a cabinet defining a storage cavity with an access opening at a face of the cabinet; and a door hinged to the cabinet face to cover the access opening, the door having a top member, framing, a floating face panel and an overlay panel mounted to the face panel for concealing the cabinet, wherein the framing defines a retaining lip extending around at least a portion of the perimeter of the face panel disposed within a gap between the overlay panel and the face panel so as to retain the face panel in the door;

wherein the door further includes a filler material disposed behind the face panel to bias the face panel against the retaining lip.

* * * * *

UNITED STATES PATENT AND TRADEMARK OFFICE

CERTIFICATE OF CORRECTION

PATENT NO. : 6,935,712 B2
DATED : August 30, 2005
INVENTOR(S) : William A. Reed et al.

It is certified that error appears in the above-identified patent and that said Letters Patent is hereby corrected as shown below:

Column 7,
Line 21, change “right comer” to -- right corner --.
Line 21, change “front comer” to -- front corner --.

Column 7,
Line 35, change “the comer” to -- the corner --.

Signed and Sealed this

Thirteenth Day of December, 2005

JON W. DUDAS
*Director of the United States Patent and Trademark Office*